US005799981A

United States Patent [19]

Tung et al.

[11] Patent Number: 5,799,981

[45] Date of Patent: Sep. 1, 1998

[54] PHARMACEUTICAL MARKETING DEVICE AND SYSTEM

[75] Inventors: James C. Tung, Blue Bell; Norman Werther, Fort Washington, both of Pa.

[73] Assignee: Global Healthcomm, Inc., Abington, Pa.

[21] Appl. No.: 504,632

[22] Filed: Jul. 20, 1995

Related U.S. Application Data

[63] Continuation-in-part of Ser. No. 439,730, May 12, 1995.

[51] Int. Cl.[6] ..... B42D 15/00

[52] U.S. Cl. ..... 283/56; 283/900; 283/98; 283/101; 283/51

[58] Field of Search ..... 283/900, 81, 56, 283/98, 101, 51, 79; 40/299, 310, 638; 281/21.1

[56] References Cited

U.S. PATENT DOCUMENTS

| | | | |
|---|---|---|---|
| 2,652,149 | 9/1953 | O'Meara . | |
| 2,877,893 | 3/1959 | Volckening . | |
| 3,305,077 | 2/1967 | Greif et al. . | |
| 3,494,322 | 2/1970 | Dubbels . | |
| 3,503,493 | 3/1970 | Nagy . | |
| 3,515,265 | 6/1970 | Bartnik . | |
| 3,625,547 | 12/1971 | Burke | 283/21.1 |
| 3,856,144 | 12/1974 | Kelly . | |
| 3,952,942 | 4/1976 | O'Leary et al. . | |
| 3,958,693 | 5/1976 | Greene . | |
| 3,958,750 | 5/1976 | Prybeck . | |
| 4,011,985 | 3/1977 | Simson . | |
| 4,029,341 | 6/1977 | Neill et al. . | |
| 4,159,129 | 6/1979 | Lockhart . | |
| 4,189,053 | 2/1980 | Stagnitto et al. . | |
| 4,365,708 | 12/1982 | Tyus . | |
| 4,526,404 | 7/1985 | Vazquez | 283/79 |
| 4,601,490 | 7/1986 | Brandon . | |
| 4,616,852 | 10/1986 | Cash . | |
| 4,706,996 | 11/1987 | Fasham . | |
| 4,955,481 | 9/1990 | Novinski et al. . | |
| 4,976,351 | 12/1990 | Mangini et al. . | |
| 4,991,877 | 2/1991 | Lieberman . | |
| 5,022,522 | 6/1991 | Kennedy . | |
| 5,046,609 | 9/1991 | Mangini et al. . | |
| 5,048,870 | 9/1991 | Mangini et al. . | |
| 5,076,490 | 12/1991 | Dulin . | |
| 5,096,058 | 3/1992 | Juravin et al. . | |
| 5,174,451 | 12/1992 | Niven . | |
| 5,178,419 | 1/1993 | Bolnick | 283/81 |
| 5,181,743 | 1/1993 | Lloyd . | |
| 5,199,662 | 4/1993 | Klupt . | |
| 5,209,349 | 5/1993 | Porter et al. . | |
| 5,232,248 | 8/1993 | Talbott . | |
| 5,242,055 | 9/1993 | Pora . | |
| 5,324,077 | 6/1994 | Kessler et al. . | |
| 5,328,208 | 7/1994 | Garrison . | |
| 5,342,094 | 8/1994 | Duck . | |
| 5,361,897 | 11/1994 | Poehler . | |
| 5,370,223 | 12/1994 | Leicht, Jr. . | |
| 5,390,796 | 2/1995 | Kerfoot, Jr. . | |
| 5,393,100 | 2/1995 | Coe . | |

*Primary Examiner*—Willmon Fridie, Jr.
*Attorney, Agent, or Firm*—Caesar, Rivise, Bernstein, Cohen & Pokotilow, Ltd.

[57] ABSTRACT

A marketing device and system which enables a company or a designated representative to communicate with other persons involved in the marketing and administration of medical products, including the physician, the patient and the pharmacist. The marketing device comprises multiple, separable segments. These segments can include a product information segment to be affixed to a patient's chart; a disease state management segment to be affixed to a patient's chart; a mailer segment to be returned to the manufacturer of a product or to the manufacturer's representative including patient-related information and, if desired, instructions to the pharmacist to dispense, without charge to the recipient, a specified quantity of a medical product; a pharmacist receipt segment to be signed by the recipient of the free product; a bank check segment made payable to an endorsing pharmacist; a pair of prescription segments; a product sample segment and a patient-education segment for providing information to the patient regarding the disease being treated and/or the prescribed product.

32 Claims, 8 Drawing Sheets

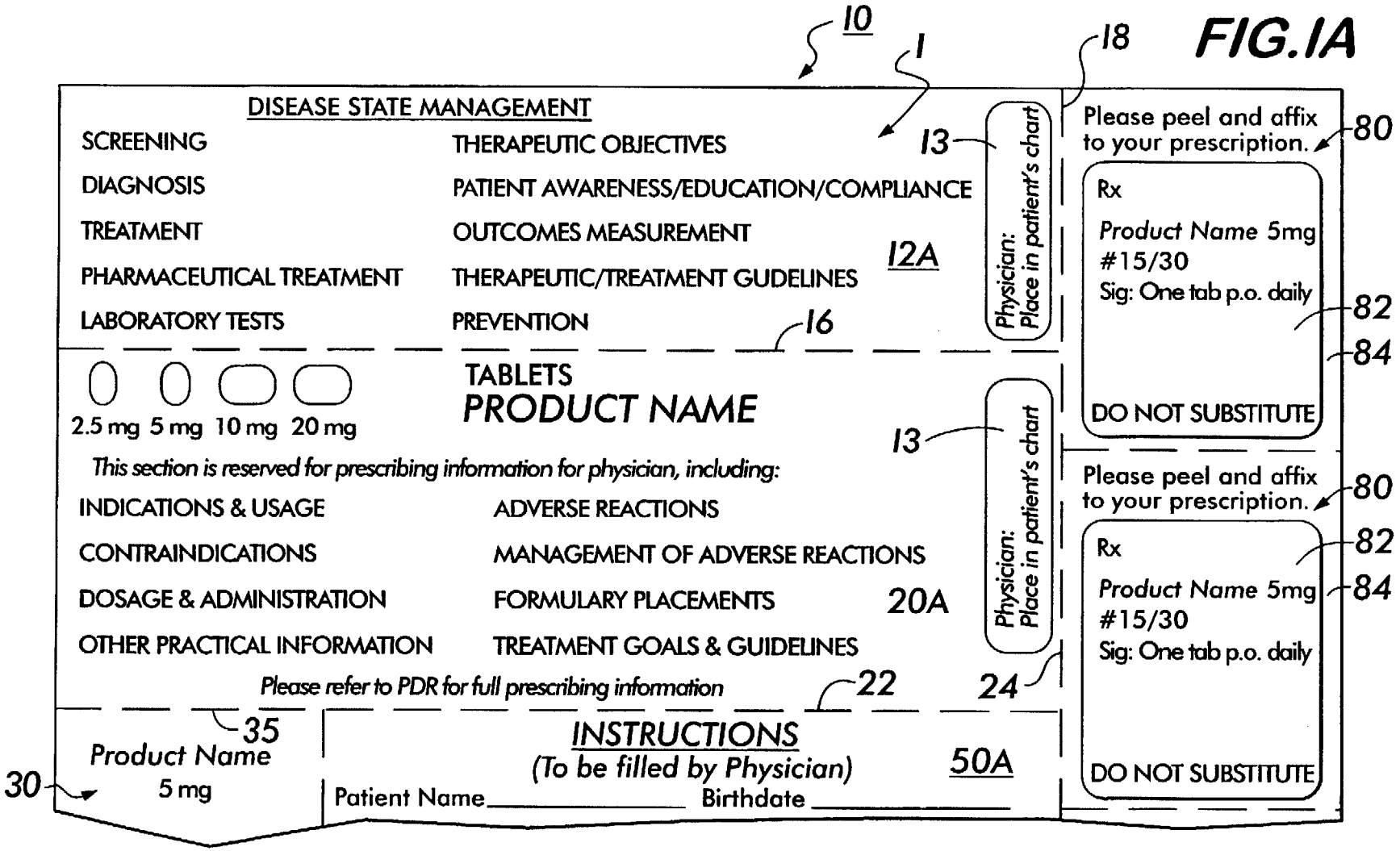
FIG.1A
10
1
18
Please peel and affix to your prescription.
80
Rx
Product Name 5mg
#15/30
Sig: One tab p.o. daily
82
84
DO NOT SUBSTITUTE
Physician:
Place in patient's chart
13
DISEASE STATE MANAGEMENT
SCREENING
DIAGNOSIS
TREATMENT
PHARMACEUTICAL TREATMENT
LABORATORY TESTS
THERAPEUTIC OBJECTIVES
PATIENT AWARENESS/EDUCATION/COMPLIANCE
OUTCOMES MEASUREMENT
THERAPEUTIC/TREATMENT GUIDELINES
PREVENTION
12A
16
2.5 mg 5 mg 10 mg 20 mg
TABLETS
PRODUCT NAME
This section is reserved for prescribing information for physician, including:
INDICATIONS & USAGE
CONTRAINDICATIONS
DOSAGE & ADMINISTRATION
OTHER PRACTICAL INFORMATION
ADVERSE REACTIONS
MANAGEMENT OF ADVERSE REACTIONS
FORMULARY PLACEMENTS
TREATMENT GOALS & GUIDELINES
20A
22
Please refer to PDR for full prescribing information
INSTRUCTIONS
(To be filled by Physician)
Patient Name
Birthdate
24
50A
35
Product Name
5 mg
30

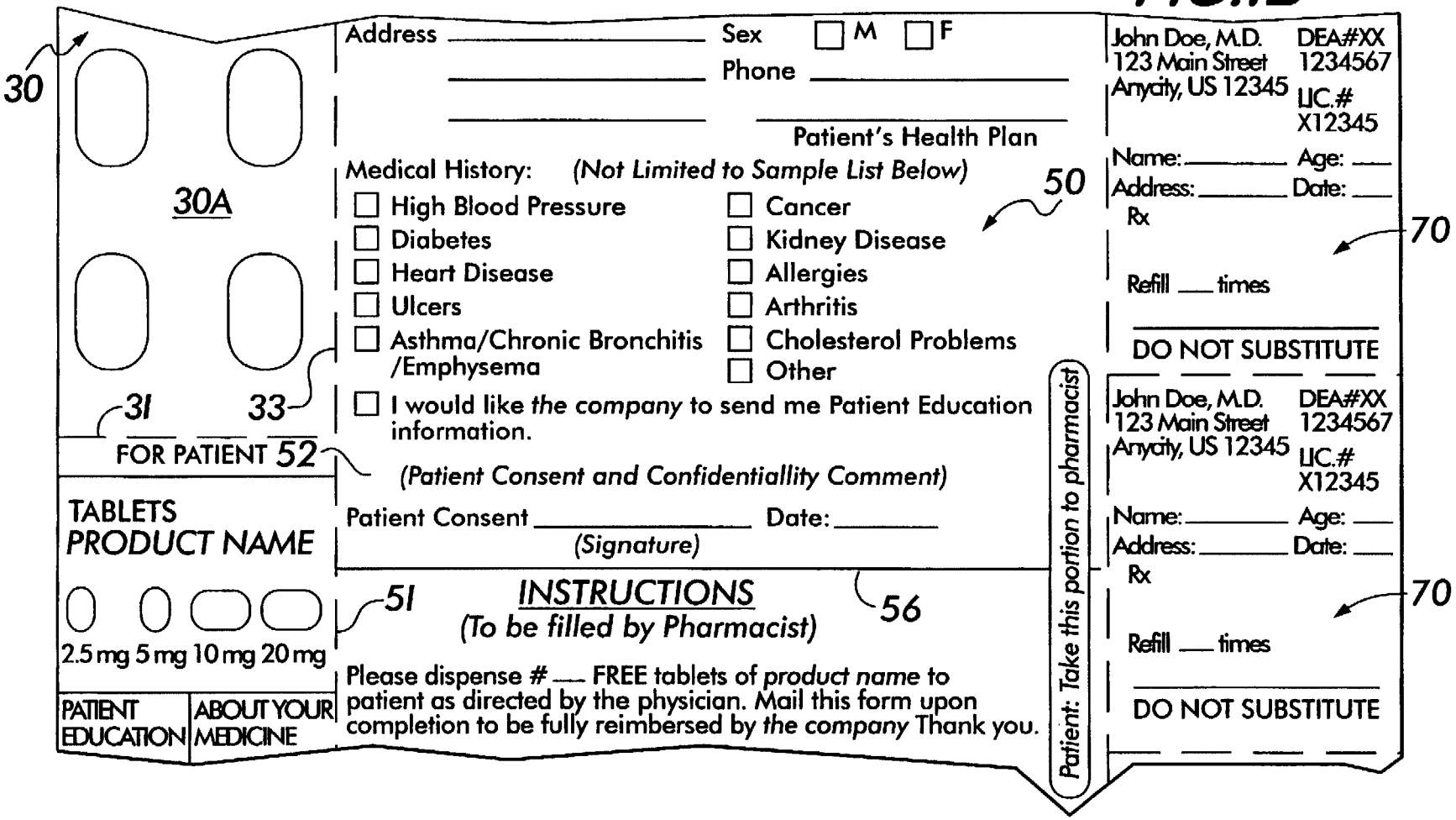
FIG. 1B
30
30A
31
33
FOR PATIENT 52
TABLETS
PRODUCT NAME
2.5 mg 5 mg 10 mg 20 mg
PATIENT EDUCATION
ABOUT YOUR MEDICINE
Address
Sex ☐ M ☐ F
Phone
Patient's Health Plan
50
Medical History: (Not Limited to Sample List Below)
☐ High Blood Pressure
☐ Diabetes
☐ Heart Disease
☐ Ulcers
☐ Asthma/Chronic Bronchitis /Emphysema
☐ Cancer
☐ Kidney Disease
☐ Allergies
☐ Arthritis
☐ Cholesterol Problems
☐ Other
☐ I would like the company to send me Patient Education information.
(Patient Consent and Confidentiallity Comment)
Patient Consent _____ Date: _____
(Signature)
51
INSTRUCTIONS
(To be filled by Pharmacist)
56
Please dispense # ___ FREE tablets of product name to patient as directed by the physician. Mail this form upon completion to be fully reimbersed by the company Thank you.
Patient: Take this portion to pharmacist
John Doe, M.D. DEA#XX 1234567
123 Main Street LIC.# X12345
Anycity, US 12345
Name: _____ Age: ___
Address: _____ Date: ___
Rx
Refill ___ times
DO NOT SUBSTITUTE
70

PHARMACEUTICAL MARKETING DEVICE AND SYSTEM

RELATED APPLICATIONS

This application is a continuation-in-part of U.S. application Ser. No. 08/439,730, filed on May 12, 1995, and entitled Pharmaceutical Marketing Device and System. The entire disclosure of the '730 application is incorporated herein by reference.

BACKGROUND OF THE INVENTION

This invention relates generally to the field of marketing medical products, and most preferably pharmaceutical products. More specifically, this invention relates to a pharmaceutical marketing device and system for improving communications between entities involved in the health care field, and more specifically, entities involved in the manufacture, use, prescribing, and/or dispensing of medical products (e.g., pharmaceutical products).

Various devices for marketing and testing pharmaceutical products are known. U.S. Pat. No. 3,625,547 (Burke) discloses a composite prescription form comprising five individual parts, including a detachable part to be used as a prescription label, another which is used as a stack label, a third part constituting the prescription, a fourth part which is a copy of the original prescription and a fifth part secured to the patient's prescription ledger card. This form is intended to reduce the average amount of time used by pharmacists in filling a prescription.

U.S. Pat. No. 5,178,418 (Bolnick) comprises a multi-segment form with labels. The first and second label segments contain information identifying the patient participating in a drug study, the drug being tested and other study information. The third label contains hidden information on whether the particular patient has been prescribed a drug or a placebo. The hidden information may be uncovered by the physician if the patient's condition deteriorates.

U.S. Pat. No. 4,526,404 (Vasquez) discloses a label bearing container holding clinical products such as blood products. The label can be removed and attached to the patient's chart to indicate that the clinical product was administered to the patient.

Various other devices for marketing products are known including a prescription form which incorporates a sample of the drug to be administered; as well as other composite marketing devices, such as those used in the sale of photographic film, which incorporate a mailer to return the exposed film to the company for processing.

However, the prior art does not disclose a marketing device and system which is capable of establishing and maintaining communications between the pharmaceutical company or its designated representative, e.g., a marketing company or a database company, and the physician, patient, and pharmacist involved in the prescribing, use, and dispensing, respectively, of a drug or other medically-related product.

In applicants' earlier-identified U.S. application Ser. No. 08/439,730, the subject matter of which already has been incorporated by reference herein, unique devices are disclosed for enhancing communications among the prescriber of a medical product (e.g., a health care provider such as a physician), a recipient of that product (e.g., a patient), a manufacturer of the product (e.g., a pharmaceutical company), and/or insurance company, and a dispenser of the product (e.g., a pharmacist). These devices include multiple segments that are separable from each other. One segment can include product-specific information (which can be attached to a patient's chart by a treating physician). An additional segment can include a free sample of the product. A further additional segment can include a mailer addressed to the manufacturer of the product or to the manufacturer's agent or insurance company or managed care company. This mailer includes locations in which a health care provider or dispenser of the product can provide medically-related information about the recipient or intended recipient of the product. This mailer also can instruct a pharmacist to dispense a specified quantity of the product to a patient free of charge or at a discount, and can advise the pharmacist that the specified quantity will be reimbursed to him upon receipt of the mailer by the manufacturer of the product or by the manufacturer's agent.

Although the multi-segment communication devices described and claimed in applicants' copending '730 application are considered to be effective for enhancing communications among entities involved in providing health care services and products, a need is believed to exist for an improved communication device having a number of additional capabilities that are not possessed by the communication devices described and claimed in the aforementioned '730 application. In particular, a need is believed to exist for a communication device having the capability of communicating disease state management information (e.g., general and specific information regarding the disease being treated) to a health care provider (e.g., a physician) and providing continued easy access to such information by the health care provider. In addition, a need is believed to exist for a communication device having the capability of minimizing or eliminating the dispensing of excessive quantities of free samples of a product by a health care provider to a recipient (e.g., a patient). Moreover, a need also is believed to exist for a communication device which enables the intended recipient of a medically-related prescription product to obtain an immediate supply of the prescription product from his or her pharmacist, and also to obtain additional supplies of the product from mail order companies, generally at a substantial cost reduction compared to the price charged by a neighborhood, or local pharmacist.

In accordance with this invention, the marketing device and system may include separable segments providing one or more of the above-mentioned capabilities that are not possessed by the device and system disclosed in applicants' earlier-identified '730 application, and also one or more of the segments that are included in the device and system disclosed in applicants' earlier-identified '730 application.

SUMMARY OF THE INVENTION

The above and other objects of this invention are achieved in a device and system for marketing a medical product comprising a multi-segment member having a plurality of separable segments and means for detaching each of said separable segments from said multi-segment member. A first separable section includes specific information relating to the medical product and is attachable to a member external to said device; preferably a patient's chart. The device also can include an additional separable segment including information relating to the treatment of a condition for which the medical product is employed, and this additional segment also is attachable to a member external to said device; preferably a patient's chart.

In one preferred form of the invention the multi-segment member is a unitary member comprising the separable segments. However, the segments can be in the form of a multi-leaf or multi-page booklet, if desired. When the multi-segment member is a unitary member the means for detaching each of said separable segments includes a weakened region (e.g., a line of weakness e.g., a line of perforations) between said segments.

In accordance with this invention, the device can include an additional separable section providing a sample quantity of a medical product and/or a further separable section in the form of a check or coupon made payable to a dispenser of the product. Preferably when a check or coupon is included as a removable segment it is in the form of a bank check and includes indicia identifying the prescriber of the product.

In accordance with this invention, the device and system can include a further additional separable segment in the form of a mailer addressed to a provider of the product (e.g., a manufacturer of the product, such as a pharmaceutical company, or an agent of the manufacturer, such as a database company retained to handle communications on behalf of the manufacturer). Such a mailer can include medical, demographic, and quality-of-life feedback (while on drug or medical therapy) information relating to a recipient of the product (e.g., a patient) and demographic information relating to a dispenser of the product (e.g., a pharmacist). The quality-of-life feedback provides real world information that can be reported to all concerned with the patient's care, with outcome results used to drive patient educational programs to improve patient's welfare. In fact, the mailer segment can be identical to the mailer segment described and claimed in applicants' aforementioned '730 application. Unless specifically limited, reference throughout this application, including the claims, to a "provider of the product" includes a manufacturer of the product or an agent or other party intended to receive communications on behalf of the manufacturer.

Also in accordance with this invention, the device and system can include a further additional separable segment in the form of a receipt to be retained by the pharmacist or other dispenser of the product and including an identified area to be signed by the patient or other recipient of the product to evidence receipt of a specific quantity of the product by the recipient from the dispenser of the product. This receipt can be of the same form as described in applicants' aforementioned '730 application.

In accordance with a preferred form of the invention the device and system can include additional separable segments in the form of two prescription segments to be completed by the prescriber of the product (e.g., a physician) and to be given to an intended recipient of the product (e.g., a patient). Each of these segments can be a conventional prescription sheet or can be in the form of a peel-off label secured to a release liner of the device. In this latter form of the invention, each of said peel-off labels is removable from its underlying release liner and is attachable to another prescription sheet of the provider of the product.

In accordance with the broadest aspects of this invention, the various removable segments described above can be employed in various different combinations, as desired. However, in the most preferred forms of the invention, one of the separable segments includes specific information relating to a medical product and is attachable to a member external to said device; preferably a patient's chart. Most preferably, the device combines with the separable segment including specific information relating to a medical product an additional separable segment including information relating to the treatment of a condition for which the medical product is employed. Most preferably, this additional segment also is attachable to a member external to said device; preferably a patient's chart having the condition being treated.

DESCRIPTION OF THE DRAWING

Other objects and many of the attendant advantages of this invention will readily be appreciated as the same becomes better understood by reference to the following detailed description when considered in connection with the accompanying drawings wherein.

Figure 1C:
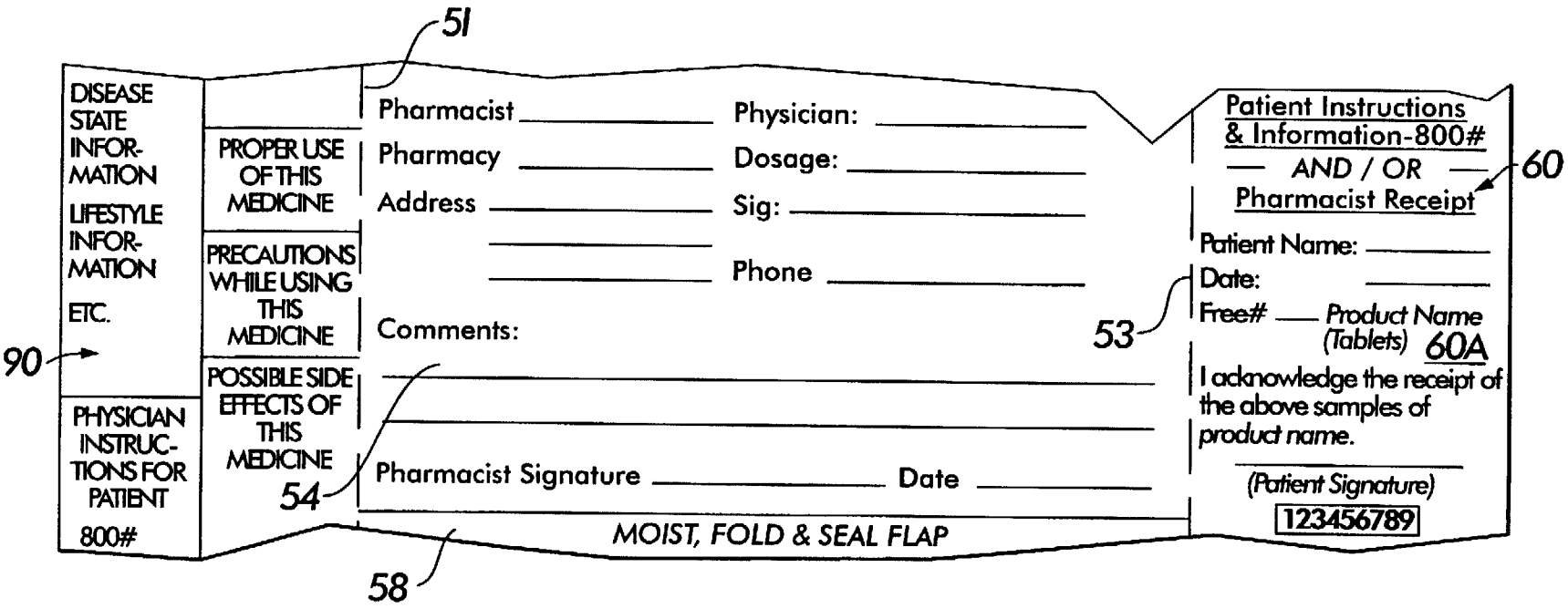
FIG. 1 is a view of the front side of a marketing device and system employing multiple removable or separable segments in accordance with this invention.

The marketing device and system in accordance with the broadest aspects of this invention is not required to include—and indeed will not include—each and every segment shown in the drawing. In fact, the removable or separable segments can be combined in a variety of ways, with various segments being omitted, depending upon the needs or desires of the user of the system.

DETAILED DESCRIPTION OF THE PREFERRED EMBODIMENTS

Figure 1D:
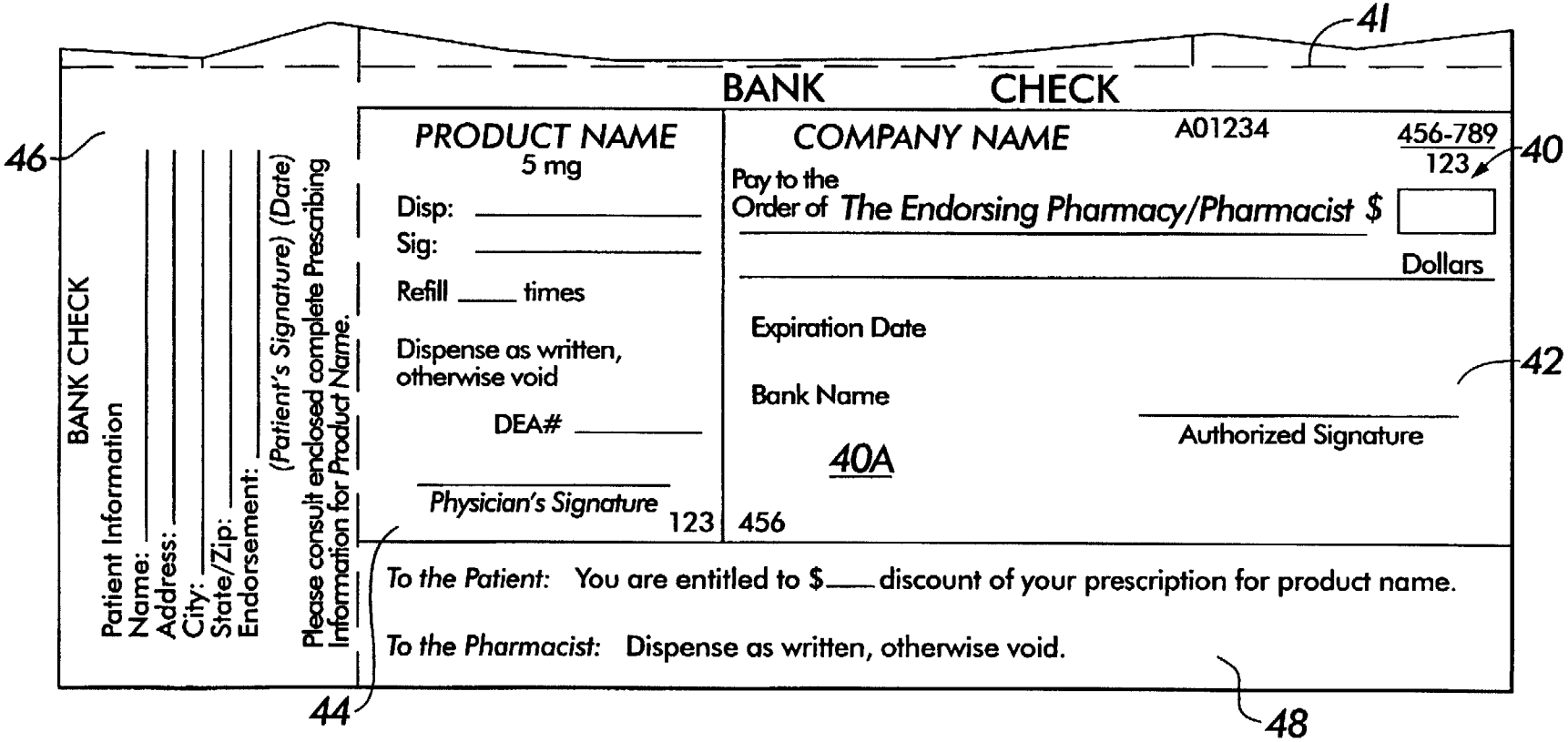
Figure 2A:
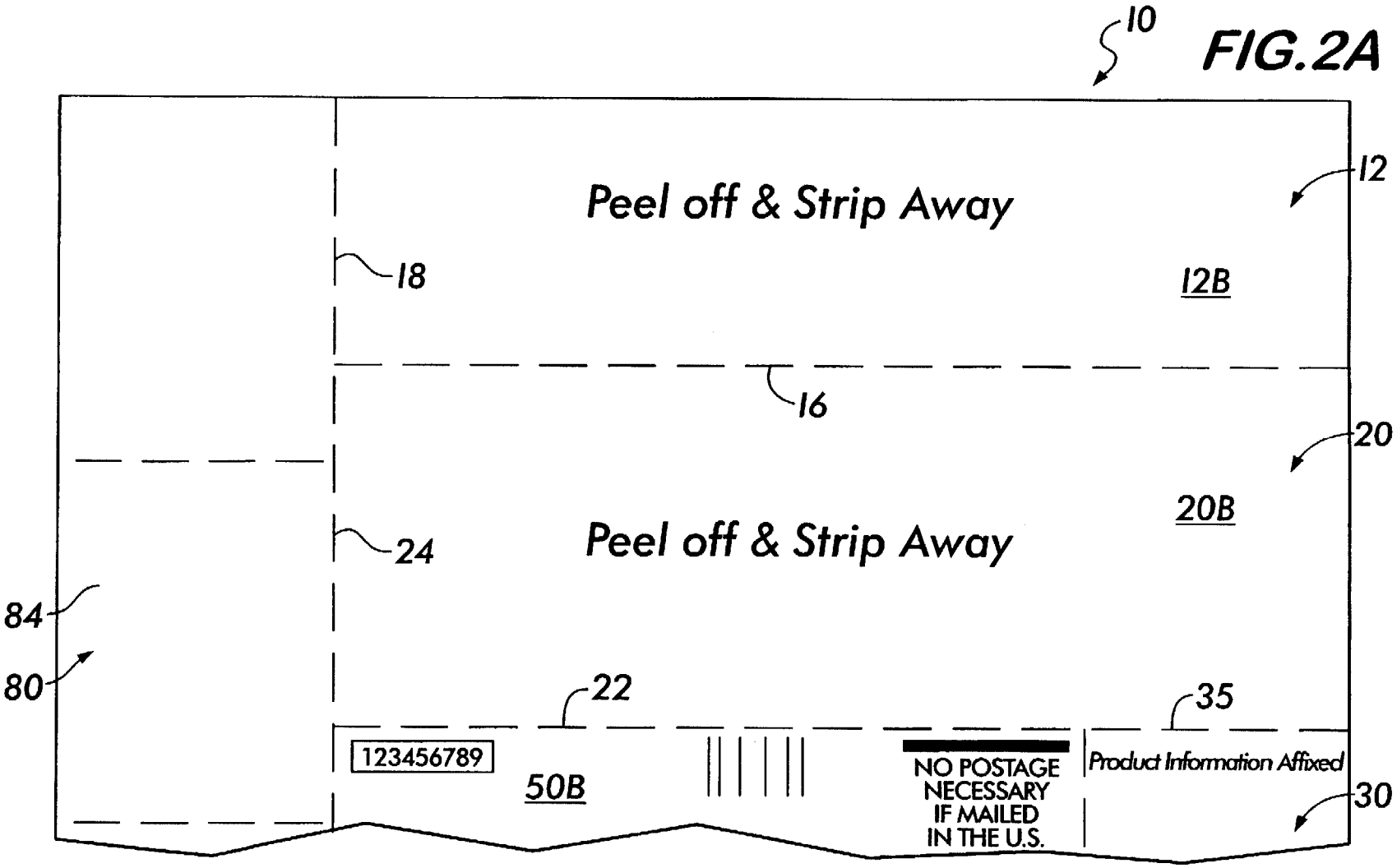
FIG. 2 is a view of the back side of the marketing device and system shown in FIG. 1.
Figure 2B:
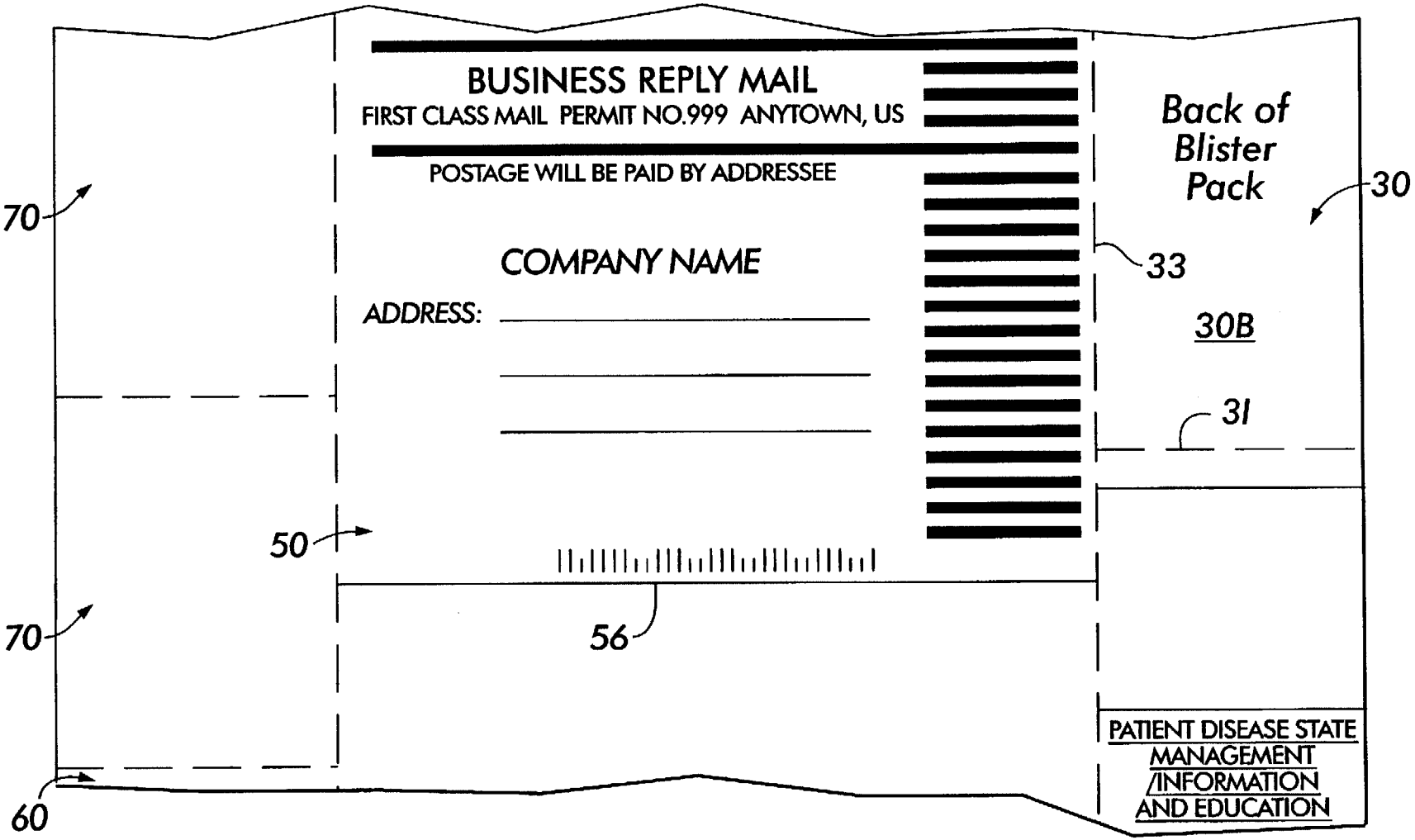
Figure 2C:
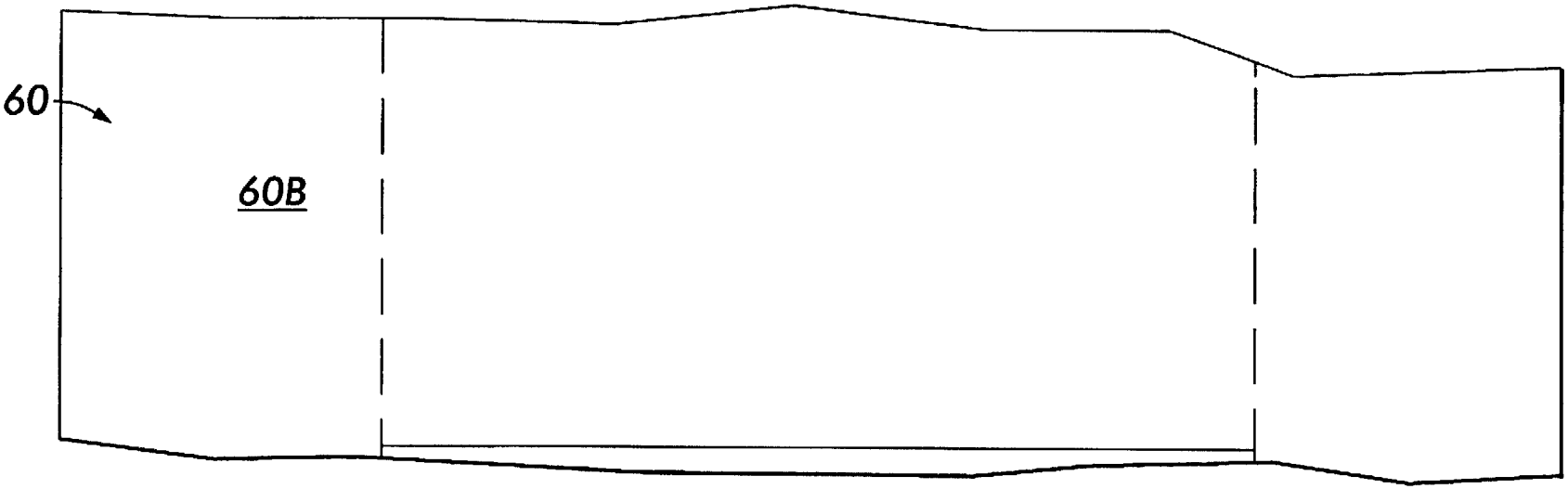
Figure 2D:
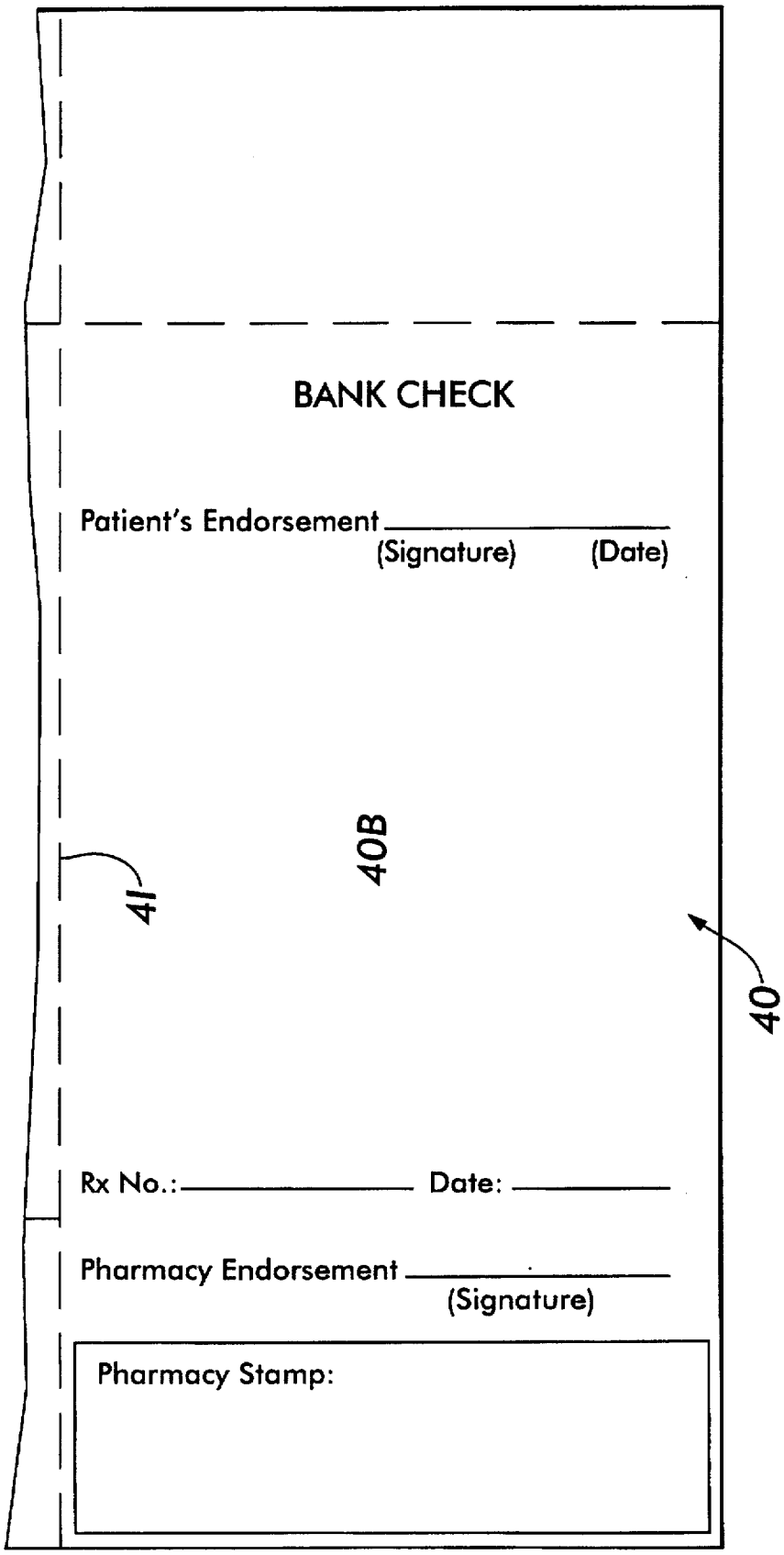

Referring now in greater detail to the various figures of the drawings, wherein like reference characters refer to like parts, a marketing device and system employing the present invention is generally shown at 10 in FIGS. 1 and 2. The marketing device and system 10 is a multi-segment member (in the illustrated embodiments it is a unitary member with separable sections provided by lines of weakness, e.g., lines of perforations).

It is important to note that this invention is not only applicable to the marketing of prescription (branded or generic) pharmaceutical/medical products, but also to the marketing of other medical products, such as over-the-counter non-prescription pharmaceutical products, and other types of medical products.

Also, as explained earlier herein, although the device 10 illustrated in the drawing includes numerous different separable sections, all of these segments are not required to be included in a commercial device and system of this invention. For example, and not by way of limitation, if the product being marketed is not a prescription product, then there is no need for the device to include removable segments in the form of prescriptions. Also, in certain forms of the invention a free product sample segment may not be included, and instead a check or coupon segment may be included, all as will be described in greater detail hereinafter. Also, in certain forms of the invention a removable segment relating to disease state management may not be included, and in other forms of the invention, both a free product segment and a check or coupon segment may be omitted. In fact, in accordance with the broadest aspects of this invention various combinations of two or more of the illustrated segments can be employed, depending upon the intended use or function of the device.

In this detailed description, the notations for the various sections on the front side of the marketing device as shown in FIG. 1 are given as numerals followed by the suffix "A". The back side of the marketing device (FIG. 2) is given numerals followed by the suffix "B". Thus, the fronts of the segments of the marketing device 10 include the notations 12A, 14A, 16A, and so forth, and the corresponding rears of the segments of the marketing device 10 include the notations 12B, 14B, 16B, and so forth.

Turning now to the Figures, the marketing device 10 includes a removable segment 12 directed to disease state management, which is adapted to be attached to a patient's chart. This disease state management segment 12 is a laminate including a front sheet 12A having information with respect to a particular disease, rather than to one product for use in treating the disease, and a back sheet 12B in the form of a release liner or peel-off strip. Certain disease state management protocols exist for a variety of diseases, such as asthma, hypertension and diabetes. These protocols include general and specific information and developed algorithms regarding a number of factors, such as procedures for screening for the disease, for diagnosing the disease, and for treatment of the disease, including, when appropriate, dietary restrictions, exercise protocol, acceptable medications under varying conditions of the disease, e.g., mild symptoms or attack, severe attack, etc. A number of general categories of information included in the disease state management segment 12 of the device are identified in FIG. 1. However, other categories of information could be included, if desired.

The disease state management segment 12 includes indicia 13 instructing the physician, or other health care provider, to attach the segment 12 to the patient's chart. In this latter regard, the disease state management segment 12 is attached to the remainder of the marketing device 10 through lines of perforations 16 and 18.

In use, the segment 12 is separated from the remainder of the device 10 through the lines of perforations 16 and 18, the release liner 12B is removed from the front sheet 12A, and the front sheet 12A is attached to a patient's chart (not shown) through the adhesive layer exposed by removal of the release liner 12B. If desired, the lines of perforations 16 and 18 can be provided only through the front sheet 12A, and the release liner 12B can remain attached to the device 10 as a permanent part of said device. In this latter form of the invention, the front sheet 12A is peeled-off of the release liner 12B for attachment to a patient's chart, and the release liner remains attached to the other segments of the device 10.

In a preferred form of the invention, the disease state management segment 12 is combined with a product information segment 20 that also is intended to be attached to a patient's chart. The product information segment 20, like the disease state management segment 12, is a laminate including a front sheet 20A and rear sheet 20B in the form of a release liner. The front sheet 20A includes information regarding a specific product that is usable in the treatment of the disease forming the subject matter of the disease state management segment 12. Whereas, the disease state management segment 12 may generally advise the physician of the acceptability of one or more products for treating a specified disease, as well as when, or under what circumstances such product(s) should be used to treat the disease, the product information segment 20 gives detailed information about one specific product for treating the disease. Such detailed information can include recommended doses; possible side effects; adjustments to be made to the dosage in light of specific outcomes, side effects; etc.; adjustments to be made to diet in the event of certain side effects; etc. In general, the product information segment 20 includes information taken from the Physicians Desk Reference and/or product insert and/or other FDA (Federal Drug Administration) approved sources. In fact, the product information segment 20 can include the same identifying indicia as the product identification segment 4 described in applicants' aforementioned '730 patent application.

As can be seen in the Figures, the product information segment 20, like the disease state management segment 12, includes indicia 13 instructing the physician (or other health care provider) to attach the front sheet 20A of segment 20 to the patient's chart. To permit the segment 20 to be separated from the remainder of the marketing device it is attached to the remainder of the marketing device through lines of perforations 16, 22 and 24. Line of perforations 24 is a linear extension of the line of perforations 18.

In use, the segment 20 is separated from the remainder of the device 10 through the interconnecting lines of perforations 16, 22, and 24, the release liner 20B is removed from the front sheet 20A, and the front sheet 20A of segment 20 is attached to a patient's chart (not shown) through the adhesive layer exposed by removal of the release liner. If desired, the lines of perforations 16, 22, and 24 can be provided only through the front sheet 20A, and the release liner 20B can remain attached to the device 10 as a permanent part of said device. In this latter form of the invention, the front sheet 20A is peeled-off of the release liner 20B for attachment to a patient's chart, and the release liner remains attached to the other segments of the device 10.

If desired, the marketing device 10 can include, in addition to the disease state management segment 12 and the product information segment 20, a product sample segment 30 and/or a bank check segment 40 made payable to the endorsing pharmacist to provide payment to the pharmacist or other dispenser for a sample-size quantity of a specific product. This payment is intended to be credited to the patient, in the form of a discount for the product. A second bank check may also be included for payment to the prescriber (physician) to fill in patient information.

In one preferred form of the invention the bank check segment 40 is utilized in place of a product sample segment 30. This reduces the possible abuse by health care providers (e.g., physicians) of giving excessive quantities of free samples to a recipient (e.g., patient).

The bank check segment 40 preferably includes a front surface 40A and a rear surface 40B. The front surface 40A includes a check section 42, which is made payable to "The Endorsing Pharmacist", a preprinted prescription section 44 identifying the product to be dispensed and including space for the doctor to fill in information regarding the quantity to be dispensed and the required method of taking the medication. In addition, the front surface 40A includes a section 46 for identifying the patient, including his/her address, and may or may not include a section 48 advising the patient that he/she is entitled to a discount for the prescription equivalent to the amount of the bank check section 42 and instructing the pharmacist or other provider of the medical product to dispense the product in the form authorized by the physician or other health care provider. Preferably the bank check segment 40 is coded for physician (prescriber) identification.

Referring to FIG. 2 the rear portion 40B of the bank check segment 40 includes sections for receiving the endorsements of the patient to whom the product is dispensed and of the pharmacist dispensing the product to the patient. This bank check segment 40 is at the bottom of the device 10 and is removable connected to the system or device 10 by a single line of weakness (e.g., a line of perforations) 41.

As noted above, a product sample segment 30 can be included either with or without the bank check segment 40. The product sample segment 30 can be in any desired form for packaging the sample of the product, it being understood that the configuration of the product sample segment will be dictated in part by the form of the sample to be dispensed, e.g., pill, capsule, liquid, powder, inhaler, etc. In the form illustrated herein the product sample segment 30 is in the form of a conventional blister pack for individual capsules/pills, including a cardboard backing layer 30B and a plastic blister 30A adhered thereto by a suitable adhesive and/or bonding technique. This product sample segment 30 is removably secured to the device 10 through lines of weakness (e.g., perforate lines) 31, 33 and 35. It should be noted that the line of weakness 35 is a continuous, linear extension of the line of weakness 22 partially connecting the product information segment 20 to the device 10.

Although the preferred embodiments of the invention include both a disease state management segment 12 and a product information segment 20, it is within the scope of this invention to include only a product information segment 20 in combination with a product sample segment 30 and/or a bank check segment 40. As noted earlier, the bank check segment 40 is made payable to the endorsing pharmacist in an amount to compensate the pharmacist for dispensing a predetermined sample-size quantity of a specified product. This amount should be discounted from the sales price to the patient, and, as noted above, the bank check segment 40 includes indicia advising the patient that he/she is entitled to such a discount.

The system 10 employing a product information segment 20, either with or without the disease state management segment 12, and further including a removable segment 30 containing a sample quantity of a specific product and/or a removable bank check segment 40 made payable to the endorsing product dispenser can be combined with one or more additional removable segments, if desired.

For example, the system 10 can be combined with a mailer segment 50 to be returned to the manufacturer of the product or a designated agent of the manufacturer, such as a database company, as is fully described in our aforementioned copending '730 application. This mailer segment 50 includes a front portion 50A with certain patient and pharmacist information indicia on it, to be more fully described hereinafter. The mailer segment 50 also has a rear portion 50B including the relevant return mail information on it.

The front portion 50A of the mailer segment includes a first section 52 including patient information (e.g., patient's medical history/prescription history, including over-the-counter medications), provided either by the provider of medical services (e.g., the physician) or the provider of the product (e.g., the pharmacist). The patient information section may be computer coded for electronic scanning. The front portion 50A of the mailer segment also can include a second section 54 with instructions to the pharmacist to dispense a specified number or quantity of the product, and instructions that the quantity so dispensed will be reimbursed upon receipt by the manufacturer (or the designated agent) of the return mailer segment 50 including the patient information on it. The second section 54, as illustrated, identifies the pharmacist, the physician, and dosage information.

The first and second sections 52 and 54 of the mailer segment 50 are connected by a fold line 56, along which the mailer 50 is folded to conceal the indicia/information contained on the front portion 50A thereof. In order to secure the mailer in its folded condition a flap section 58 with an adhesive stripe on it is secured to an end of the second section 54 remote from the fold line 56. The adhesive stripe is activated by being wet and then is folded into engagement with an underlying region of the rear portion 50B of the mailer segment 50 after the mailer segment has been separated from the remainder of the device 10 and folded along the fold line 56. The return mailer segment 50 is removably secured to the device 10 through lines of weakness 22, 33, 51, 41, and 53. The mailer segment 50 can be identical to that described in our aforementioned copending '730 patent application.

If desired, the system 10 also can include a removable pharmacist receipt segment 60 having a front surface 60A that is to be signed by the patient after the patient receives the required free supply of the product for which the pharmacist is to be reimbursed. This signature constitutes an acknowledgment by the patient that he/she has received the amount of the product specified on the receipt. As illustrated, the receipt 60 is removably attached to the remainder of the device 10 through a portion of lines of weakness 41 and 53. This receipt can be identical to the receipt that is fully described in our aforementioned copending '730 patent application. If desired, segment 60 also can include instructions and information for a patient, including a toll-free number that the patient can call for further information. Such instructions and/or information can be in addition to or in place of the receipt, depending upon the needs of the user of the device 10.

The receipt segment 60, when one is included in the device 10, should be retained by the pharmacist so that he/she can provide it to the manufacturer or the manufacturer's representative as proof that the free sample was actually dispensed to a customer. The pharmacist may be called upon to produce such a receipt in the event that the manufacturer or its agent either does not receive, or misplaces, the return mailer segment 50 returned by the pharmacist, and therefore fails to forward to the pharmacist the reimbursing amount/quantity that the pharmacist was instructed to dispense to the patient free-of-charge. Of course, it is only desirable to include the receipt section when the device 10 also includes a section (e.g., section 50) authorizing a pharmacist to give a free sample of a product for which the pharmacist is to be reimbursed.

It is within the scope of the invention to provide a mailer segment solely with a section 52 for including the patient information illustrated in FIG. 1, but without a further section (e.g., 54) authorizing the dispensing of a reimbursable supply of the product. Although this type of mailer segment is not separately depicted in the drawings, it should be understood that it is identical to the mailer segment 50 but with the lower section 54 either being blank or including a promotional incentive (as described hereinafter) for the physician or pharmacist to complete the mailer segment and return it to the manufacture of the product or to the manufacturer's agent. Specifically, in this latter form of the invention it is desirable to offer a financial incentive for the physician or pharmacist to obtain the patient information, e.g., the patient's medical history and/or prescription history, and to return the mailer segment 50 to the manufacturer of the product (e.g., drug) or to the manufacturer's agent. Such a financial incentive may be necessary because the incentive of being reimbursed for a quantity of product dispensed free-of-charge to a patient does not exist, because the pharmacist or other dispenser of the product is not being instructed to provide such a free sample to the patient. Such a financial incentive can be an offer to pay the physician/pharmacist, e.g., $3.00–$5.00, for his/her efforts. Thus, the mailer segment can include a statement on lower section 54 thereof that either the physician or the pharmacist will be reimbursed a specified amount for completing the form and returning it to the designated party. In addition, this incentive can be combined with the bank check segment 40 described above, to pay the pharmacist or other provider of the product for a limited quantity of the product that the provider is instructed to dispense to a patient free-of-charge. As noted above, this payment may be a credit/discount to the patient, and the bank check segment 40 should include information to that effect.

As a further and/or other addition to the system 10, a pair of identical removable prescription segments 70 can be included. Each prescription segment 70 can be identical to that described at 210 in our copending '730 patent application, and includes a self-contained prescription for use by the physician or other prescriber of the product to be dispensed. One prescription segment 70 is intended to be given to the pharmacist so that an immediate supply of the prescribed product can be obtained. The other prescription segment 70 can be used by the recipient of the system to order the prescribed product through a mail order company that normally takes an extended period of time to fill and deliver the prescription, e.g., a few weeks. Thus, the first prescription segment 70 can be used to provide an immediate few week's supply of the product, so that the patient subsequently can avail himself or herself of the generally lower prices that can be obtained through mail order purchases of the drug.

The two prescription segments optionally can be laminated segments 80, each including a top, peel-off adhesive label 82, as is depicted in FIG. 1, secured to a lower, or underlying release liner 84 for the labels, as is depicted in FIGS. 1 and 2. These peel-off labels 82 include the name of the product to be dispensed, the quantity to be dispensed, and, if desired, pre-printed instructions relating to the dosage to be taken. Optionally the labels 82 can include blank spaces for the physician to designate the quantity of the product to be dispensed and the dosage to be taken. These peel-off labels 82 are employed by first removing the prescription segments 80 from the device 10 along their attaching lines of weakness. Thereafter each of the labels 82 is removed from the release lining 84 to which it is attached, and then each label 82 is attached to a standard prescription sheet of the physician. Alternatively, the lines of weakness can be omitted, in which case the labels 82 are peeled off of their respective release liners 84 without the necessity of removing the release liners 84 from the remainder of the device 10.

As with the embodiment employing two complete prescriptions 70 as removable segments, two of the labels 82 are employed so that the physician can easily prepare two prescriptions; one to be given directly to a local provider of the product (e.g., the patient's pharmacist), and the other to be transmitted to a mail order supplier of the product so that subsequent supplies of the product can be purchased at a reduced price.

It should be clearly understood that optionally either the segments 80 including the peel-off labels 82 are employed in the system or the two full prescriptions 70 are employed in the system, since both the labels 82 and the prescriptions 70 are intended to serve the same purpose, and be used in exactly the same manner.

As a further and/or other addition to the system a removable patient information segment 90 can be included. This segment is removably connected to the device 10 by the indicated lines of weakness, and includes information to be communicated directly to the patient. This latter information can include part of the same information provided to the physician in the disease state management segment 12 and/or the product information segment 20. For example, and not by way of limiting the present invention, this patient information segment 90 can include information regarding any lifestyle changes/procedures that the patient should make/follow, special instructions for the patient, specific information about the product, proper procedures for using the product, precautions with respect to using the product, possible side effects, and steps to be taken to deal with such side effects. The patient education segment may include colored pictures of the actual product to enable the patient to carefully identify what he or she is being prescribed and dispensed. Moreover, the device 10 can include any desired language, and clearly is not limited to the English language.

Without further elaboration the foregoing will so fully illustrate our invention that others may, by applying current or future knowledge, adopt the same for use under various conditions of service.

We claim:

1. A device for marketing a pharmaceutical product comprising multiple segments separable from each other, said multiple segments comprising:

(a) A first separable segment having a front surface with information relating to the product and a rear surface including adhesive means thereon, said first segment being sized for attachment through said adhesive means to a patient's medical record retained by a healthcare provider; and (b) an additional separable segment having a front surface including information relating to the treatment of a condition for which said pharmaceutical product is employed and a rear surface including an adhesive means thereon, said additional separable segment being sized for attachment through said adhesive means to a patient's medical record retained by a healthcare provider.

2. The device of claim 1, wherein said multiple segments are part of a unitary member.

3. The device of claim 1, further comprising an additional separable section including at least one free sample of said product.

4. The device of claim 3, further including an additional separable segment in the form of a check or coupon made payable to a dispenser of the product.

5. The device of claim 4, wherein said check is a bank check.

6. The device of claim 4, wherein said check includes indicia identifying the prescriber of the product.

7. The device of claim 3, further including a further additional separable segment in the form of a mailer addressed to a provider of the product, said mailer including information relating to a recipient of the product.

8. The device of claim 7, wherein said mailer includes instructions to a dispenser of the product to dispense a specific quantity of the product to the recipient.

9. The device of claim 8, including a further additional separable segment in the form of a receipt to be retained by the dispenser of the product and including an identified area to be signed by the recipient to evidence receipt of the specific quantity of the product by the recipient from the dispenser of the product.

10. The device of claim 1, including a further additional separable segment in the form of a check or coupon made payable to a dispenser of the product.

11. The device of claim 10, wherein said check is a bank check.

12. The device of claim 10, wherein said check includes indicia identifying the prescriber of the product.

13. The device of claim 10, further including a further additional separable segment in the form of a mailer addressed to a provider of the product, said mailer including information relating to a recipient of the product.

14. The device of claim 13, wherein said mailer includes instructions to the dispenser of the product to dispense a specific quantity of the product to the recipient.

15. The device of claim 14, including a further additional separable segment in the form of a receipt to be retained by the dispenser of the product and including an identified area to be signed by the recipient to evidence receipt of the specific quantity of the product by the recipient from the dispenser of the product.

16. The device of claim 1, including additional separable segments in the form of two prescription segments to be completed by the provider of the product and to be given to an intended recipient of the product.

17. The device of claim 16, wherein each of said prescription segments is a peel-off label having an adhesive on a rear surface thereof, each of said labels being secured to a release liner of the device through said adhesive on said rear surface, each of said peel-off labels being removable from said release liner and being sized for attachment to another prescription sheet of the provider of the product.

18. A device for marketing a medical product comprising a multi-segment member having a plurality of separable segments and means for detaching each of said separable segments from said multi-segment member, said multi-segment member comprising:

(a) a first separable segment having information relating to the product, said first segment being attachable to a member external to said device; and (b) an additional separable segment in the form of a check or coupon made payable to a dispenser of the product.

19. The device of claim 18, wherein said check is a bank check.

20. The device of claim 18, wherein said check includes indicia identifying the prescriber of the product.

21. The device of claim 18, including a further additional separable segment in the form of a mailer addressed to a provider of the product, said mailer including information relating to a recipient of the product.

22. The device of claim 21, wherein said mailer includes instructions to the dispenser of the product to dispense a specific quantity of the product to the recipient.

23. The device of claim 22, including a further additional separable segment in the form of a receipt to be retained by the dispenser of the product and including an identified area to be signed by the recipient to evidence receipt of the specific quantity of the product by the recipient from the dispenser of the product.

24. The device of claim 18, further comprising an additional separable section including at least one free sample of said product.

25. The device of claim 18, including additional separable segments in the form of two prescription segments to be completed by the provider of the product and to be given to an intended recipient of the product.

26. The device of claim 25, wherein each of said prescription segments is a peel-off label secured to a release liner of the device, each of said peel-off labels being removable from said release liner and being attachable to another prescription sheet of the provider of the product.

27. A device for marketing a medical product comprising multiple segments separable from each other, said multiple segments comprising:

(a) a first separable segment having information relating to the product, said first segment being attachable to a member external to said device; and (b) an additional separable segment including information relating to the treatment of a condition for which the medical product is employed, said second section being attachable to a member external to said device; and (c) an additional separable segment including educational information for a patient, including information relating to the medical product.

28. The device of claim 18, further comprising an additional separable section including educational information for a patient, including information relating to the medical product.

29. A device for marketing a pharmaceutical product comprising multiple segments separable from each other, one of said segments including information relating to the pharmaceutical product and being attachable to a patient's medical record, said one of said segments including adhesive means thereon for adhesive securement to said medical record ; and another of said segments being in the form of a check or coupon payable to a dispenser of the product.

30. The device of claim 29 wherein said another of said segments is a coupon payable to a dispenser of the product.

31. The device of claim 29 including a further additional segment in the form of a label with prescription information for the pharmaceutical product and being sized for attachment to a provider's prescription form, said further additional segment including adhesive means thereon for adhesive attachment to said prescription form.

32. The device of claim 29 wherein said one of said segments is a peel-off label secured to a release liner and being removable from said release liner for attachment to the patient's medical record.

* * * * *